US007952010B2

(12) United States Patent
Minakawa et al.

(10) Patent No.: US 7,952,010 B2
(45) Date of Patent: May 31, 2011

(54) STRUCTURE OF A KEY

(75) Inventors: Makoto Minakawa, Hamamatsu (JP); Shiro Uno, Hamamatsu (JP); Yukihide Takata, Hamamatsu (JP)

(73) Assignee: Roland Corporation, Hamamatsu, Shizuoka-ken (JP)

( * ) Notice: Subject to any disclaimer, the term of this patent is extended or adjusted under 35 U.S.C. 154(b) by 706 days.

(21) Appl. No.: 11/860,746

(22) Filed: Sep. 25, 2007

(65) Prior Publication Data

US 2008/0174457 A1 Jul. 24, 2008

(30) Foreign Application Priority Data

Sep. 28, 2006 (JP) ..... 2006-264600

(51) Int. Cl.
*G10D 13/02* (2006.01)

(52) U.S. Cl. ..... 84/423 R

(58) Field of Classification Search ..... 84/423 R, 84/424–425, 432, 438
See application file for complete search history.

(56) References Cited

U.S. PATENT DOCUMENTS

| | | | | |
|---|---|---|---|---|
| 3,965,791 | A | 6/1976 | Thomas et al. | |
| 4,043,244 | A | 8/1977 | Schrecongost et al. | |
| 4,059,737 | A | 11/1977 | Gergaud | |
| 2006/0219085 | A1 | 10/2006 | Kamijima et al. | |

FOREIGN PATENT DOCUMENTS

| | | | | |
|---|---|---|---|---|
| JP | 49-35209 | | 3/1974 | |
| JP | 07-44156 | | 2/1995 | |
| JP | 2003249146 | A * | 9/2003 | ..... 84/423 R |
| JP | 2005190743 | A * | 7/2005 | ..... 84/423 R |

OTHER PUBLICATIONS

Search Report dated Apr. 9, 2010 from related European patent application No. 07116869.4.

* cited by examiner

*Primary Examiner* — Kimberly R Lockett
(74) *Attorney, Agent, or Firm* — Foley & Lardner LLP

(57) ABSTRACT

A keyboard device has a plurality of keys, each key having a support base where one end of each key is supported and is arranged to allow for movement, and a plate that hides the surface of the base. The keys are created with ultrasonic welding once the base and the plate merge. Thus, it is possible to weld while merging the base and the plate together, because the base and the plate are connected by ultrasonic welding. Compared to pasting the two together using traditional adhesives, it is possible to have the base securely bound to the plate. It is then possible to have performers use the device for an extended period of time. The result is the ability to curb the chances of the base and the plate becoming loose.

18 Claims, 10 Drawing Sheets

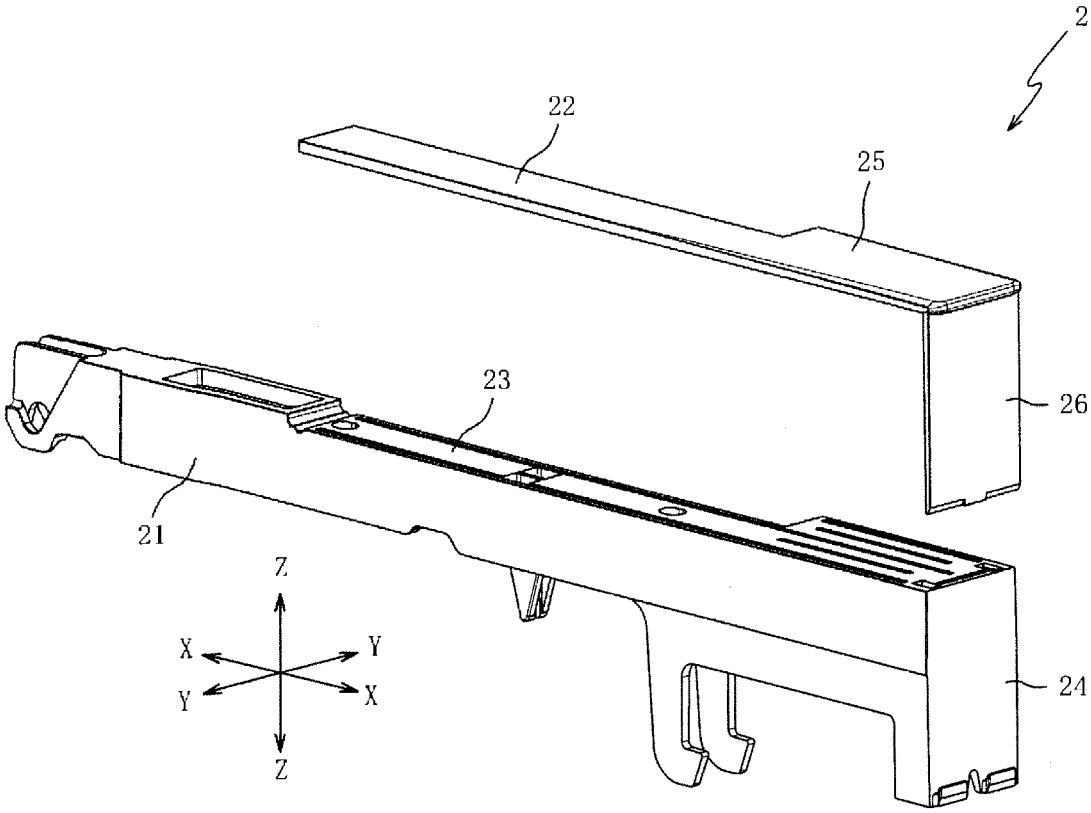
FIG. 2 ( a )
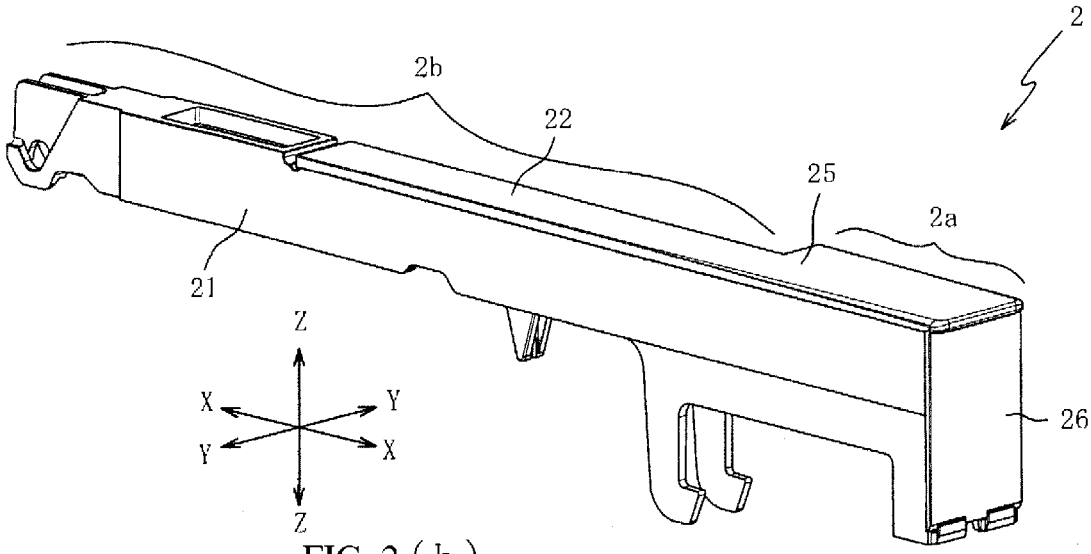
FIG. 2 ( b )

FIG. 5 ( a )
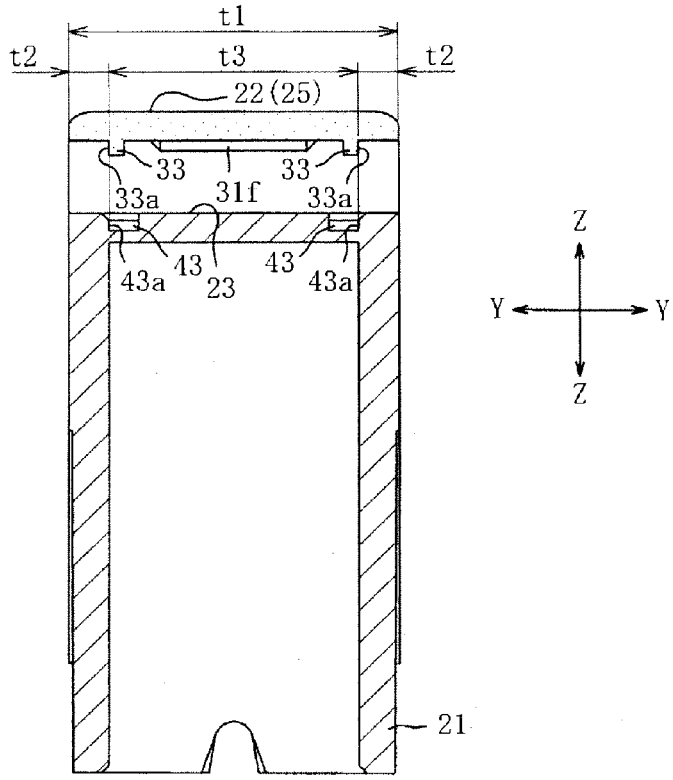
FIG. 5 ( b )
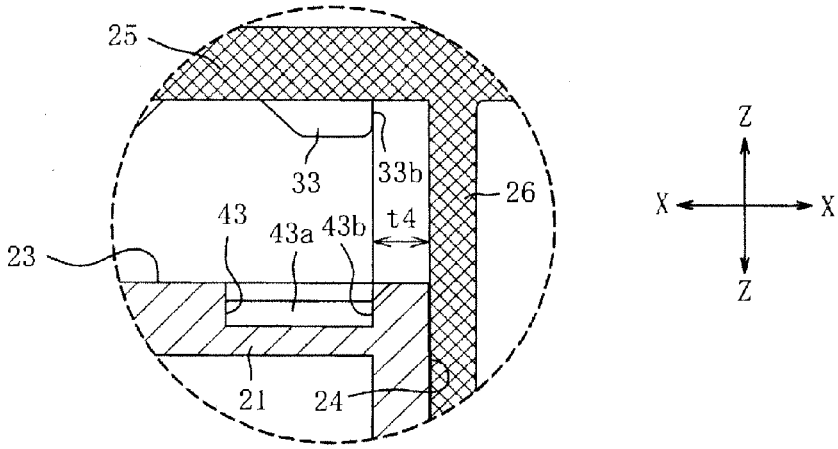
FIG. 5 ( c )
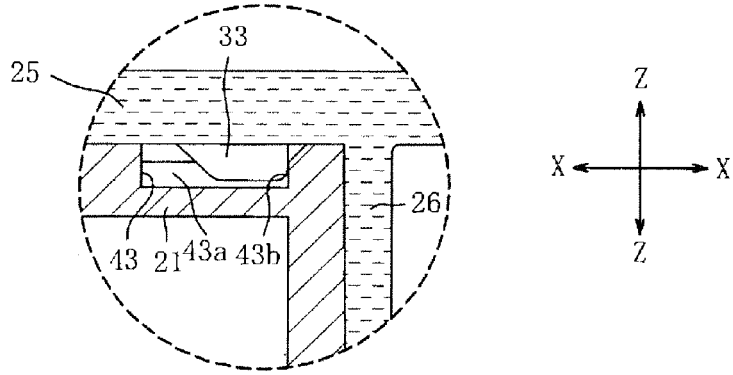

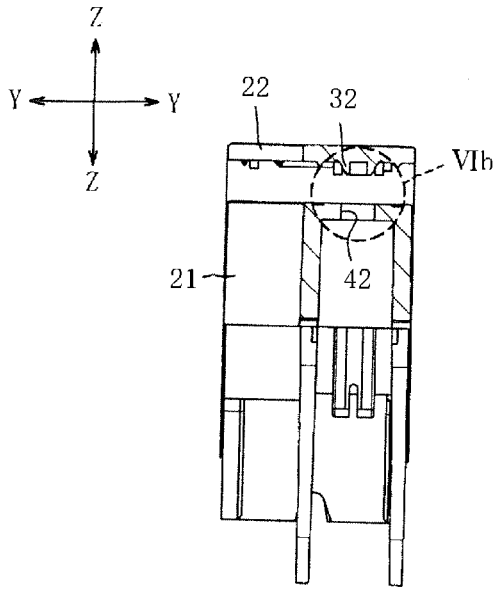
FIG. 6( a )
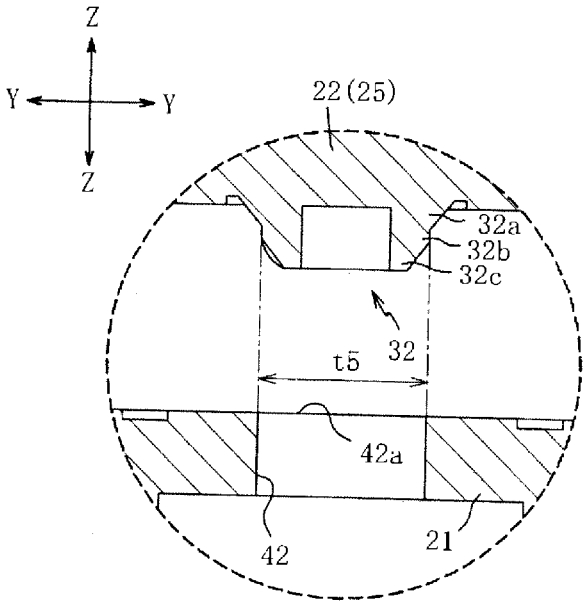
FIG. 6 ( b )
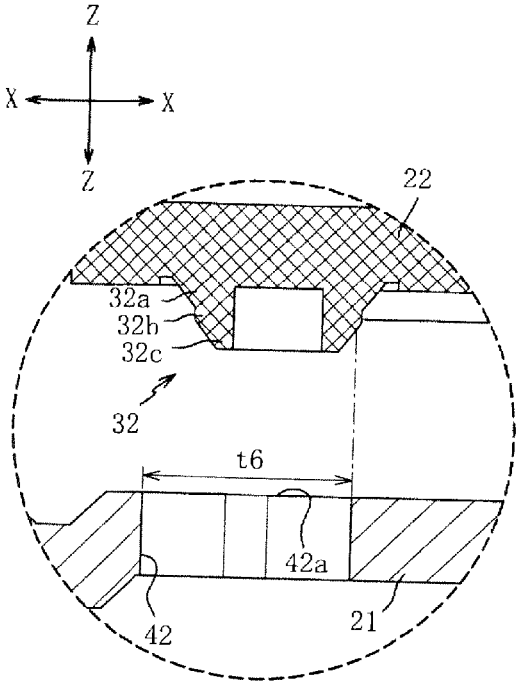
FIG. 6 ( c )
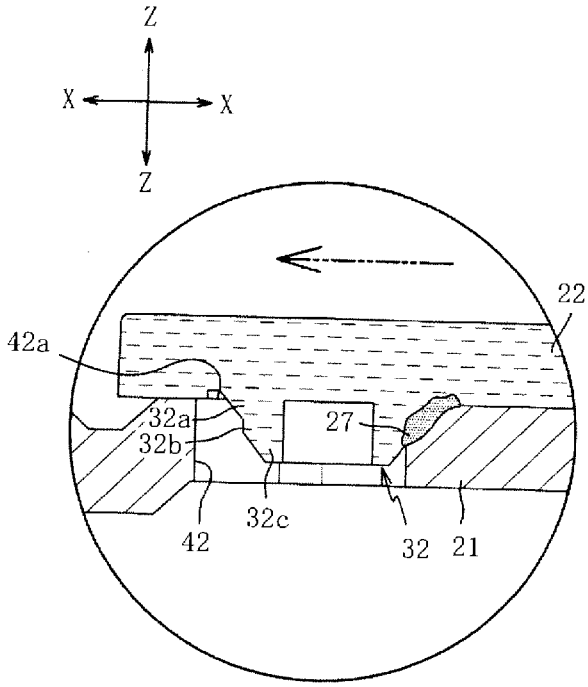
FIG. 6 ( d )

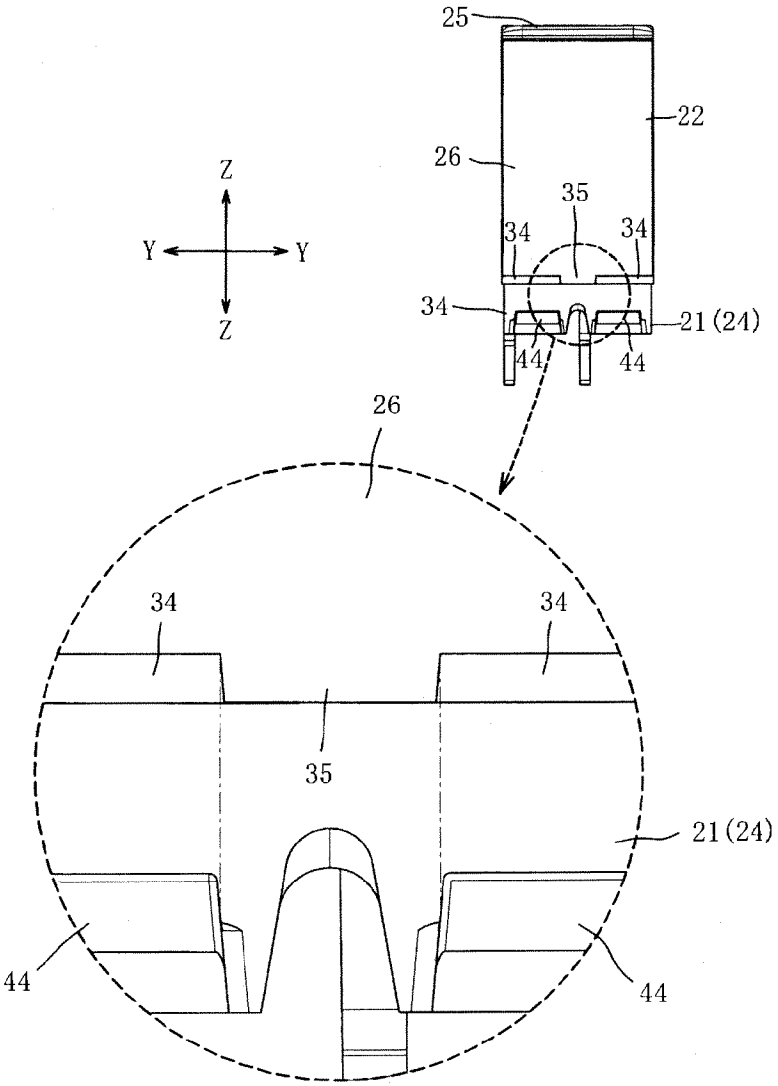
FIG. 7 ( b )
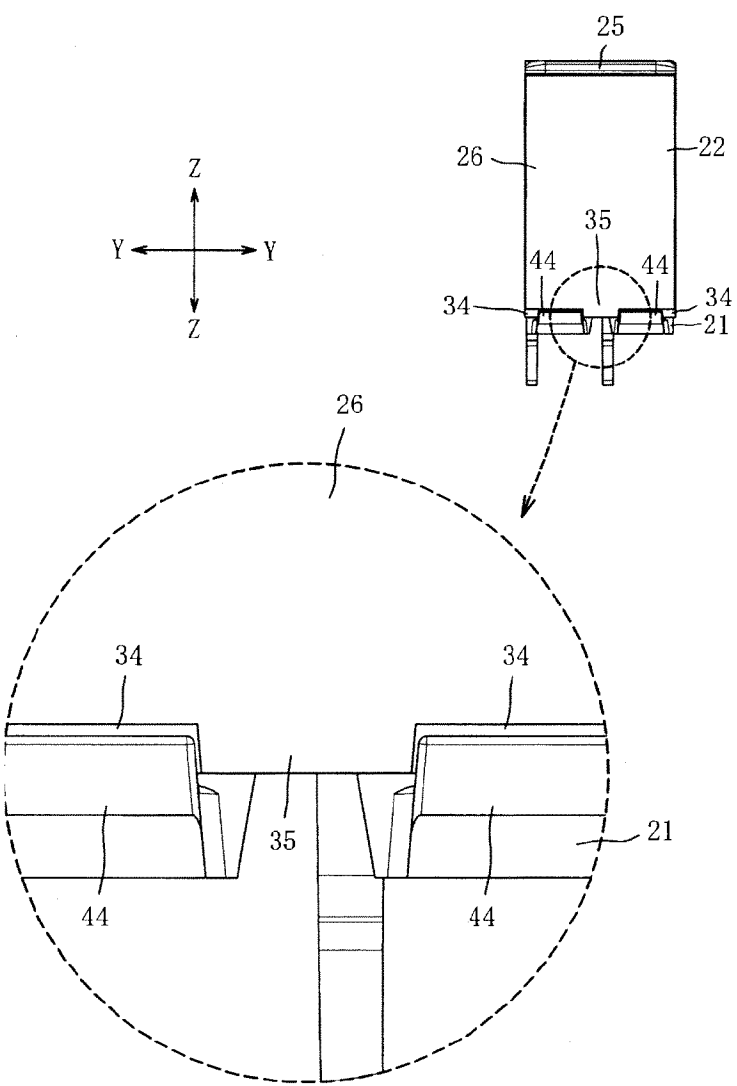
FIG. 7 ( a )

FIG. 8( a )
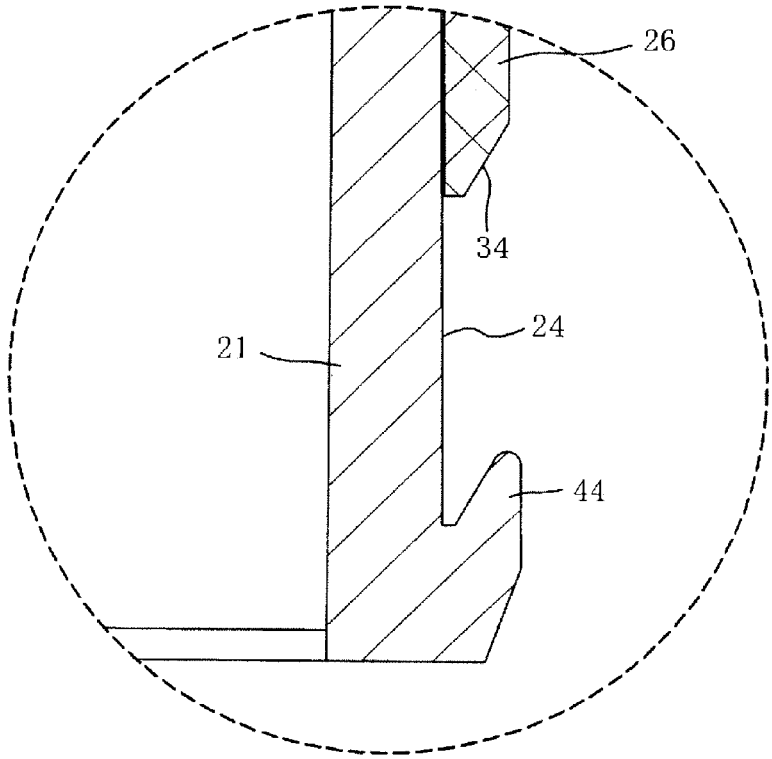
FIG. 8( b )
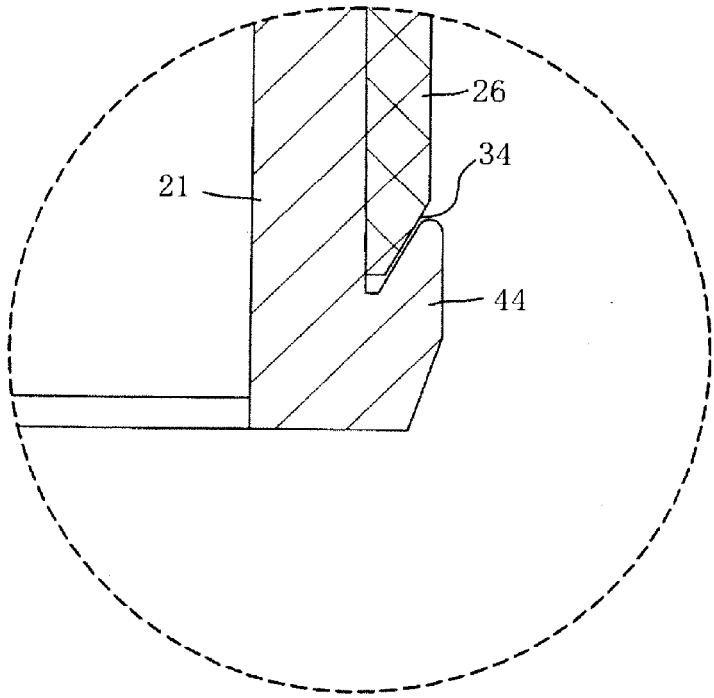

STRUCTURE OF A KEY

CROSS-REFERENCE TO RELATED PATENT APPLICATIONS

The present invention relates to Japanese Patent Application No. 2006-264600, filed Sep. 28, 2006, which is incorporated herein in its entirety and which forms a basis for a priority filing date.

BACKGROUND

The present invention relates generally to the field of keyboard devices and, more particularly, to keyboard devices that are able to reduce the occurrence of undesired sounds when pressing keys along with being able to provide a secure attachment of a cover plate to a base.

Japanese Examined Patent 1974-35209 discloses use of a hard material to increase the strength of the keys. When pressed by a musical performer, if coarse material was used to increase the absorbency, there was a problem in that the keys were weak.

The surface material (plate) submerged into absorption fluid is affixed to the key (base) surface using an adhesive. The key affixes the surface material with a different characteristic than the key surface, as described in Japanese Unexamined Patent 1995-44156.

However, the key affixed to both the base and the plate was pressed excessively by performers, and if it continued for a long period of time after being affixed, the strength of the adhesive could wear off, and the plate could become loose.

Also, because the adhesive is applied between the base surface and the plate surface, if the adhesive is not evenly distributed, one area can become loose, leaving an empty space between the base and the plate. When this empty space occurs, an undesired noise can occur when the performer touches the keys, and this may confuse the performer.

SUMMARY

Embodiments of the present invention provide a keyboard device that can reduce the occurrence of undesired noises when the keys are pressed, strengthen the bond between the base and the plate, and/or solve other problems mentioned above.

In one aspect, a keyboard device has a plurality of keys, wherein each key has a support base where one end of each key is supported and is arranged to allow for movement. The keyboard also has a plate that hides the surface of the base. The keys are formed with ultrasonic welding of the merged base and plate. It is possible to weld while merging the base and the plate together, because the base and the plate are connected by ultrasonic welding. Compared to gluing the base and plate together using traditional adhesives, it is possible to have the base securely bound to the plate. It is then possible to have performers use the device for an extended period of time. The result is the ability to reduce the chances of the base and the plate becoming loose.

In one embodiment, the base is created with a wood-coloured resin, while the plate is created with a white-coloured resin. Because the plate is created with a white-coloured resin, the result is the ability to have a keyboard device that has an elegant sense of charm with simple composition.

In one embodiment, the base and the plate may have different kinds of materials added to them. Thus, the base and the plate may be composed of a primary ingredient with a similar resin. Because different ingredients are added, the result is that it is possible to demonstrate special qualities on these objects. For example, by adding an ingredient which hardens the plate, it is possible to increase the strength of the plate. In addition, it is possible to increase the hygroscopic characteristics of a plate by adding a material which increases the water absorption characteristics of the plate. In addition, it is possible to securely fix the objects together with ultrasonic welding because the base and the plate may use the same primary ingredient.

In one embodiment, the plate has a surface on the front that hides the front side of the base. Thus, the plate is affixed from top and front surfaces. The top surface is welded by ultrasonic energy on the top surface of the base, and the front surface serves to conceal the front surface of the base. In general, because the keyboard device is aligned with and attached to the keys, the areas regularly seen by performers are the top and front surfaces. When using this keyboard device, the result is that it is possible to minimize any loss of elegance with a simple design, because the plate conceals the top and front surfaces. Also, after the base and plate are welded, the result is that it is possible to minimize the amount of manufacturing work required with the presence of the top and front surface, because only the top surface is welded by ultrasonic welding.

In one embodiment, the plate has an area or projection that protrudes from the top surface to the base for melting by ultrasonic welding.

More specifically, the plate has a surface facing the base and the surface has a first area extending from the front surface of the base to a predefined distance from the front surface. The ratio of the at least one protrusion area in the first area to the overall first area is greater than the ratio of the at least one protrusion area located outside of the first area to the overall area located outside of the first area. The edge of the keys sometimes makes undesired noises when touched if there are many cracks between the base and the plate from being pressed by performers. However, with the above ratios of welding protrusion areas relative to the areas of the plate or base, it is possible to lessen these noises and reduce the cracks between the base and the plate due to the fact that it is possible to securely weld the portion of the keys pressed by performers.

In one embodiment, the base has a convex shape in the location of the welding space once the plate has merged. Thus, it is possible to house the melted resin within the gap in case the protruding component used for welding melted, because the gap is formed at a location which corresponds to the welding space. Therefore, the result is that the melted resin remains between the top surface of the base and the plate, and it is possible to prevent the plate from slanting when being welded against the base.

In one embodiment, the welded area has an incline from front to back, and the plate has an opening connected to an inclined welding space after the plate merges. The incline may be curved, or the incline may be flat. A circular cone may be formed at the center of the path linking the front and back sides to be welded with the base. The plate will be urged toward the back side of the base as the incline is moved through the opening while welding. The result of this can create a crack between the front side of the plate and the front side of the base. The plate also cannot stay in position because it will move along the incline to the center from the edge of the opening while welding. Thus, the incline with one welding space is located at the end of the top surface of the plate. This inclined weld has a slant from the edge side to the end side. The incline is attached to an opening set up on the base. Generally, if using ultrasonic energy to weld, the incline will melt and be welded while sliding the opening to the end side, because the plate is welded by ultrasonic energy waves when held down from the top. Therefore, the result is that it is possible to improve the quality of the keys' outer surface, and also possible to prevent cracks from forming between the front ends of the base and the plate.

In one embodiment, the plate has a protuberance that penetrates through the top surface of the base. The base has enough empty space to house the front end of the protuberance and the area connected to the front side of the protuberance. The distance between the front side of the base to the linked area and the distance between the front side and the end side is substantially identical. On the base is a receptacle area with enough empty space to house the end edge on the protuberance and the linking component which links with the edge side of the protuberance. Also, in the event the plate merges with the base, the protuberance is housed while linking the receptacle area linking component and the edge end of the protuberance together, because the distance made between the edge end of the base and the linking component as well as the distance between the front surface and the edge end of the protuberance are identical. Therefore, when placing the plate on the base, the plate may be prevented from moving or sliding away from its proper position, because it is possible to select a location where movement to the edge end is restricted. Also, the yield rate may be improved and the possibility of having a defective product may be reduced, because the plate is placed in its proper position.

In one embodiment, the plate supports the protrusion area from the top portion to the base. The protrusion area is arranged in a second dimension orthogonal to the first dimension and joined with the front side and the back side. The base provides a receptacle with enough empty space to house the length of the front end of the protruding area by linking each linking space with the space outside the protrusion area in the second dimension. The distance from the outer edge of the base area to the linking space in the second dimension is the same as the distance between the outer surface on the top and the outer side of the protruding area. As in the receptacle, it may be composed of a linking component that links with the end side of the protuberance. There may also be receptacle space for housing every protuberance as there should be a component that links with the outer surface on the second path of the protuberance. Furthermore, the protuberance may hold the welded material melted by ultrasonic welding. On the edge of the protruding area linked to the linking component and the linking component for the housing space is a curved surface, or similarly, a plane or a protruding surface, or other suitable shapes. The linking component and the protrusion area are more ideal for protruding shapes from the top surface to a perpendicular path. This will make it impossible to choose a location that is easy for the protrusion area to detach from the housing space if the end of the protrusion area is obtuse on the top surface. On the other hand, if it is acute, the protrusion area may become a problem if the plate merges with the base. As used herein, "roughly equal distance" also includes identical distant. It should also be separate from ranges where it is possible to choose a location for the plate in respect to the base. This separation is ideally set by the largeness of the plate and the base. Thus, on the plate, a protuberance sits in the second dimension running orthogonally to the first dimension linking the edge with the rear end. For the base, it is equipped with a receptacle which has enough empty space to house the edge of the protuberance with the linking component linking with the edge outside the protuberance along the second dimension. Also, in the event the plate merges with the base, the protuberance is housed while linking the housing device linking component and the edge end of the protuberance together, because the distance made between the edge end of the base and the linking component as well as the distance between the front surface and the edge end of the protuberance are substantially identical. Therefore, when placing the plate on the base, the result is being able to prevent the plate from moving from its proper position to a position the plate slides to, because it is possible to select a location where movement to the second path of the plate is restricted. Also, another result is being able to improve the yield rate and reduce the possibility of having a defective product because the plate is placed in its proper position.

In one embodiment, the base has multiple support areas to support the bottom surface of the plate once the plate has merged. The plate has a space where it fits between the supports and is arranged on the bottom surface. Thus, when the plate is placed on top of the base, the lower front surface on the plate will be supported by the supports. Furthermore, the fitting space for the plate is housed between the supports. Therefore, when the plate is merged with the base, the plate is prevented from sliding away from its proper position, because of the ability to choose a location along the second dimension running orthogonally to the dimension linking the rear side with the edge using the supports and the fitting space. Also, the occurrence of undesired noises is reduced by preventing the front surface from loosely flapping from vibrations when stroking the keys, yet making it so that the front surface need not be welded because the lower section of the front surface of the plate is supporter by the support device.

In one embodiment, the front surface of the plate area forms a groove extending from the lower surface toward the top surface on the surface of the base area. The base area forms a notch area located in the place which corresponds to the grooved area at the front end of the lower surface. Thus, on the front surface of the plate, a grooved area extended from the edge of the lower section on the front surface toward the top surface is formed at the surface of the base. On the base, it is possible to apply an adhesive to this groove from the notch component with ease, because the notch component is formed at the location targeted for the groove area at the lower edge. Therefore, after the plate and the base are welded using ultrasonic energy, if a gap exists between the area on the front surface and the entire surface, it is possible to conjoin the entire front surface with the front surface portion and apply an adhesive from the notch. Thus, the result is being able to reduce the likelihood of defective products through simple manufacturing.

In one embodiment, the base has a set empty space formed between the rear end of the plate area once the plate has merged. Thus, on the base, it is possible to house the remains of a gate remaining on the rear side of the plate at a fixed space. Generally, the rear end of the keys do not affect the aesthetics of the keys and, thus, the aesthetics of the keys are not impacted by the gate on the rear end of the plate. Therefore, the result is being able to omit from the manufacturing process, a procedure for removing or otherwise processing a gate by creating this space, and in turn, being able to design a cost-efficient device.

BRIEF DESCRIPTION OF THE DRAWINGS

FIG. 1(*b*) is a side view of the keyboard device of FIG. 1(*a*);

FIG. 2(*a*) is a perspective view of a white key according to an embodiment of the present invention prior to welding;

FIG. 2(*b*) is a perspective view of the white key of FIG. 2(*a*) after the welding;

FIG. 3(*b*) is a bottom view of the key with the plate sitting on the IIIb area, FIG. 3(*c*) is a top view of the key with the plate sitting on the IIIc area, and FIG. 3(*d*) is a cross-sectional view taken along IIId-IIId of the key prior to welding;

FIGS. 5(*a*)-(*c*) are various cross-sectional views illustrating the composition of the protuberance area and the housing space according to an embodiment of the invention, wherein FIG. 5(*a*) is a cross-sectional view taken along Va-Va (in FIG. 4(*c*)) of the edge of the exemplary white key, Figure (b) is a detailed cross-sectional view of the area enclosed by the dotted line Vb in FIG. 4(*c*), and FIG. 5(*c*) is a detailed cross-sectional view of the area enclosed by the dotted line Vc in FIG. 4(*d*);

FIGS. 6(*a*)-(*d*) are various cross-sectional views illustrating the structure of the protrusion area and the hole according to an embodiment of the invention, wherein FIG. 6(*a*) is a cross-sectional view taken along VIa-VIa in FIG. 4(*a*), FIG. 6(*b*) is a detailed cross-sectional view of the area surrounded by dotted line VIb in FIG. 4(*a*), FIG. 6(*c*) is a detailed cross-sectional view of the area surrounded by dotted line VIc in FIG. 4(*c*), and FIG. 6(*d*) is a detailed cross-sectional view of the area surrounded by dotted line VId in FIG. 4(*d*);

FIGS. 7(*a*) and (*b*) illustrate the front end of the exemplary white key, wherein FIG. 7(*a*) shows the white key on arrow VIa (FIG. 4(*c*)) prior to welding, and FIG. 7(*b*) shows the white key on arrow VIIb (FIG. 4(*d*)) after welding;

FIGS. 8(*a*) and (*b*) illustrate detailed cross-sectional views of a lower section of the front end of the exemplary white key, wherein FIG. 8(*a*) is a detailed cross-sectional view of a section encompassed by dotted line VIIIa (FIG. 4(*c*)), and FIG. 8(*b*) is a detailed cross-sectional view of a section encompassed by dotted line VIIb (FIG. 4(*d*));

DETAILED DESCRIPTION

Figure 1A:
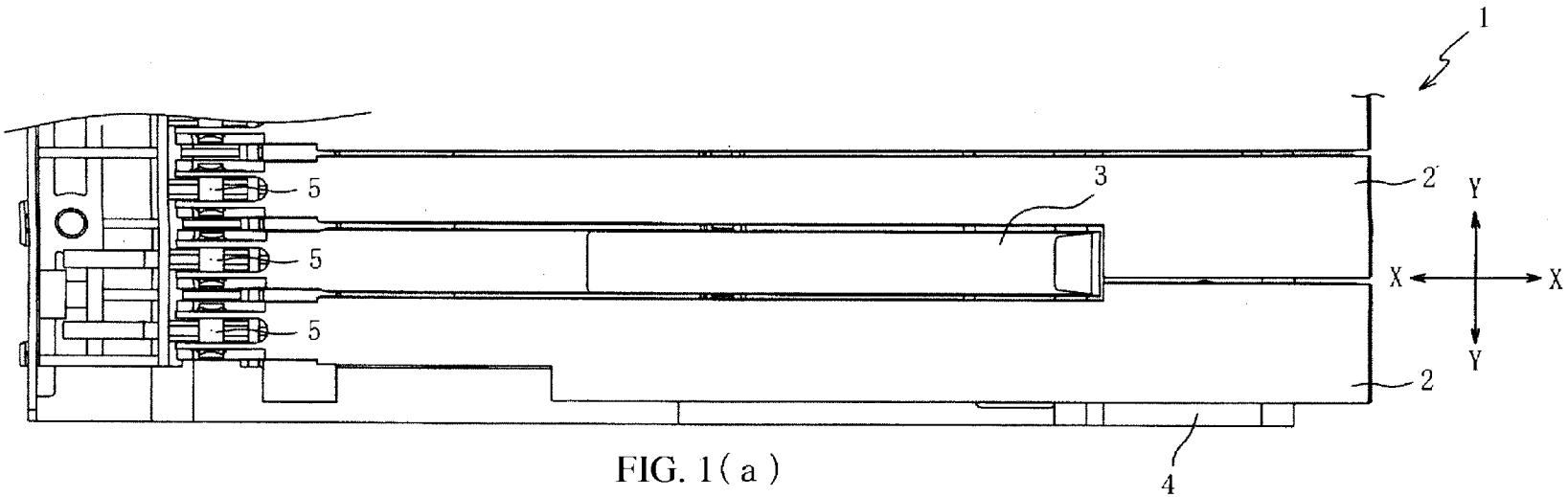
FIG. 1(*a*) is a top view of a keyboard device according to an embodiment of the present invention.
Figure 1B:
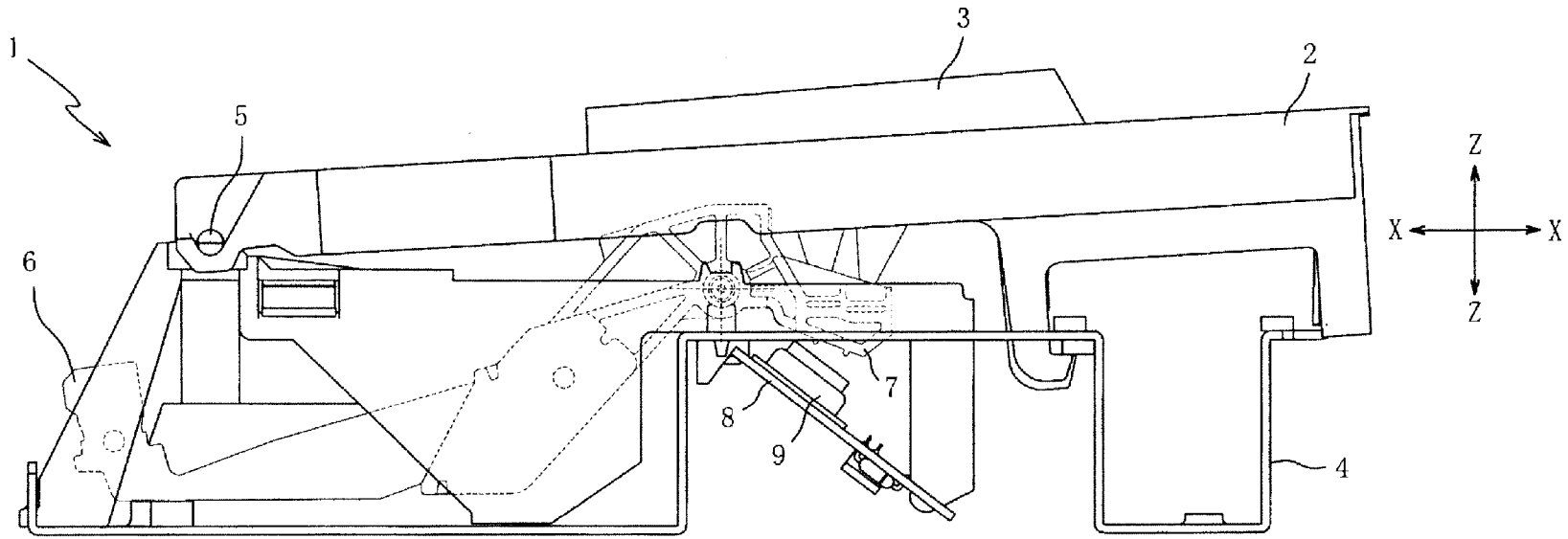

Below are examples of certain embodiments and uses for certain embodiments of the present invention, with figures for reference and elaboration. FIG. 1 shows the of a keyboard device 1 according to an embodiment of the present invention in a "real world" use. FIG. 1(*a*) illustrates a top view of a keyboard device 1, while FIG. 1(*b*) is a side-view of the keyboard device 1. Also, the explanation below illustrates a first dimension as a straight line along a white key 2 and a black key 3 (marked as dimension X), a second dimension as a path running orthogonal to X (marked as dimension Y), and a third dimension running perpendicular to the plane formed by X and Y (marked as dimension Z).

As shown in FIGS. 1(*a*) and (*b*), the keyboard device 1 is provided with several white keys 2 and black keys 3, which can be pressed by performers. White key 2 and black key 3 have axle gaps in them on one end of each key. A turning axle 5 installed on the chassis 4 is installed in the center through the axle gaps of the keys for allowing the keys to pivot.

Also, when a white key 2 or a black key 3 is pressed and pivoted about the axle 5, a corresponding hammer 6 in the chassis 4 is swung about its center and activates a switch 9 on a printed board 8, which is secured by an actuator 7 of the hammer 6 below the chassis 4. On the keyboard device 1, the key behaviour is determined by operating the switch 9, and sounds are emitted by a control unit (not shown in the figures).

FIGS. 2(*a*) and (*b*) are perspective illustrations of a white key 2 according to an embodiment of the present invention. FIG. 2(*a*) illustrates a pre-weld white key 2, while FIG. 2(*b*) illustrates a post-weld white key 2. Also, the white keys 2 have alternate shapes based on pitch. In FIG. 2, the shape of the white key 2 is such that the left side (the visible side in FIG. 2) is formed on a plane extending to roughly the entire length, while the right side (the hidden side in FIG. 2) is formed with a difference in level. Therefore, one end of the white key 2 in the X dimension is formed with a greater thickness in the Y dimension. The section with this greater thickness is on the "depressed" area 2*a* of the white key 2. The other section is on the "long/narrow" area 2*b*. (See FIG. 2(*b*)).

The white key 2 is composed of a base 21 pivotably supported on the turning axle 5, and a plate 22 concealing at least one surface of the base 21. The base 21 has a top surface 23 and a front surface 24 on a front side (in the X dimension). The plate 22 is composed of a top surface area 25 welded by ultrasonic waves to the top surface 23 of the base 21, and a front surface area 26 hiding the front surface 24 of the base 21.

Also, because the white key 2 and black key 3 are adjoined and aligned in rows (see FIGS. 1(*a*) and (*b*)), the top surface and front surface on the white key 2 are areas frequently seen by the performer. The white key 2 according to embodiments of the present invention can improve the quality of the superficial areas of keyboard device 1 with its composition.

In one embodiment, the base 21 is formed of a wood-coloured resin, and the plate 21 is formed of a white-coloured resin. Therefore, it is possible to manufacture a white key 2 with an aesthetically-pleasing appearance, while allowing assembly of the device with ease.

The base 21 and the plate 22 may be merged together by a mould made from the resin. Therefore, the base 21 and the plate 21 can be tightly bonded together by ultrasonic welding, because they may have a similar main ingredient. Also, a hard material can be added to the resin in the plate 22, thus strengthening the plate 22.

Next, with reference to FIGS. 3-10, a detailed explanation is provided of the structure of a white key 2 according to an embodiment of the present invention.

Figures 3A, 3B, 3C, 3D:
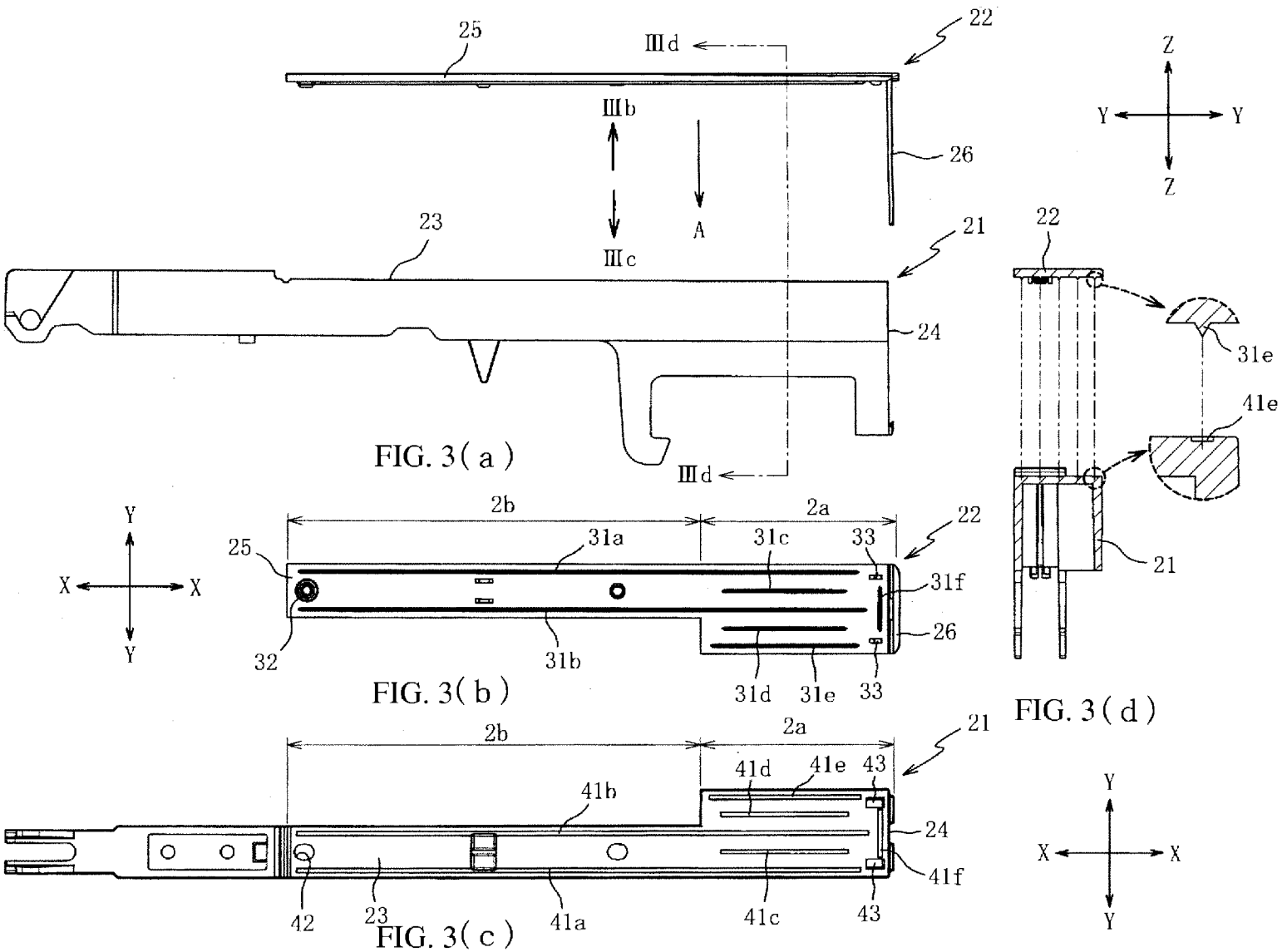
FIGS. 3(*a*)-(*d*) are various views illustrating the structure of an exemplary white key according to an embodiment of the present invention, wherein FIG. 3(*a*) is a side view of the key prior to welding.

FIGS. 3(*a*)-(*d*) illustrate the structure of white key 2. FIG. 3(*a*) is a side-view illustration of a plate 22 prior to welding, while FIG. 3(*b*) is a bottom view of the plate 22 sitting on the IIIb area in FIG. 3(*a*). FIG. 3(*c*) is a top view of the plate 22 sitting on the IIIc area in FIG. 3(*a*). FIG. 3(*d*) is a cross-sectional view taken along IIId-IIId of the white key 2 prior to welding.

As shown in FIG. 3(*a*), in producing the white key 2, the plate 22 is merged with the base 21 at a roughly perpendicular direction (arrow A). Afterwards, each key is welded by ultrasonic welding, using a welding device not shown in this diagram.

Below is an explanation of features for merging the base 21 and the plate 22 and ultrasonic welding according to an embodiment of the invention.

As shown in FIG. 3(*b*), on the top surface area 25 of the plate 22, a pair of protuberances 33 protrude out from the underside of the top surface area 25 to an approximately perpendicular position so that the plate 22 can be properly positioned with respect to the base 21. The plate 22 is also provided with welding protrusion areas 31*a-f* and protrusion 32 protruding from the underside of the top surface area 25 in an approximately perpendicular direction.

The welding protrusion areas 31*a-f* extend in a straight-line fashion along the X dimension on the plate 22. Protrusion areas 31*a* and 31*b* extend along substantially the total length of the plate 22. Protrusion areas 31*c-e* are at an area corresponding to and targeted for the key depression area 2*a* on the plate 22. Protrusion area 31*f* extends along the front edge of the plate 22 in the Y dimension. Protrusion area 32 is formed at the rear end of the plate 22. The pair of protuberances 33 are formed on each side of the protrusion area 31*f*.

As shown in FIG. 3(*c*), on the top surface area 23 of the base 21, once the plate 22 is placed down, grooves 41*a*-41*f* on the base 21 correspond to the protrusion areas 31*a*-31*f* of the plate 22, an opening or hole 42 of the base 21 corresponds to the protrusion area 32 of the plate 22, and a housing space 43 on the base 21 houses the pair of protuberances 33 on the plate 22. Thus, the grooves 41*a*-41*e*, the hole 42, and a pair of receptacles 43 each merge at a location corresponding with the protrusion areas 31*a*-31*f*, protrusion area 32, and protuberance 33, respectively.

The protrusion areas 31*a*-31*f* occupy a portion of the depression area 2*a*, and a portion of the length of protrusion areas 31*a* and 31*b* also occupy the area 2*b*. The ratio of the area occupied by the protrusion areas 31*a*-31*f* within the depression area 2*a* relative to the overall depression area 2*a* is greater than the ratio of the area occupied by the portion of the length of protrusion areas 31*a* and 31*b* that occupy the area 2*b* relative to the overall area 2*b*. In the illustrated example, the key depression area 2*a* is welded in six places (along protrusion areas 31*a*, 31*b*, 31*c*, 31*d*, 31*e*, 31*f*), while the long, narrow area 2*b* is welded in two places (along protrusions 31*a* and 31*b*). As a result, when the base 21 and plate 22 are welded together, the weld density is greater in the key depression area 2*a* than in the long, narrow area 2*b*. As a result, the key depression area 2*a* is able to avoid a gap or empty space from forming between the base 21 and the plate 22, and, thus, limit the occurrence of undesired noises caused by such gap or empty space during key depression.

Next, with reference to FIG. 3(*d*), a description is provided of the protrusion areas 31*a*-31*f* on the plate 22 and the grooves 41*a*-41*f* on the base 21. Also, because the cross-sectional view of the protrusion areas 31*a*-31*f* and the grooves 41*a*-41*f* are all respectively similar, the following description relates to the protrusion area 31*e* and the groove 41*e*.

The protrusion area 31*e* is formed in a convex, generally triangular shape on the cross-sectional view. The groove 41*e* is formed in a generally rectangular gap on the cross-sectional view. Also, the width of the groove 41*e* is larger than the width of the protrusion area 31*e*.

Therefore, once the plate 22 is placed on top of the base 21, the tip of the protrusion area 31*e* is joined with the surface of the groove 41*e*. Then, if the base 21 and the plate 22 are welded together using ultrasonic waves, the equal distribution strengthens the bond on the groove 41*e* where the protrusion area 31*e* melts. Also, it is possible to prevent the resin melted by the ultrasonic welding from jutting out within the groove 41*e*, and it is possible to avoid inadvertent welding of the top surface area 25 of the plate 22 and in a manner in which melted resin flows between the top surface 23 of the base 21.

Figures 4A, 4B, 4C, 4D:
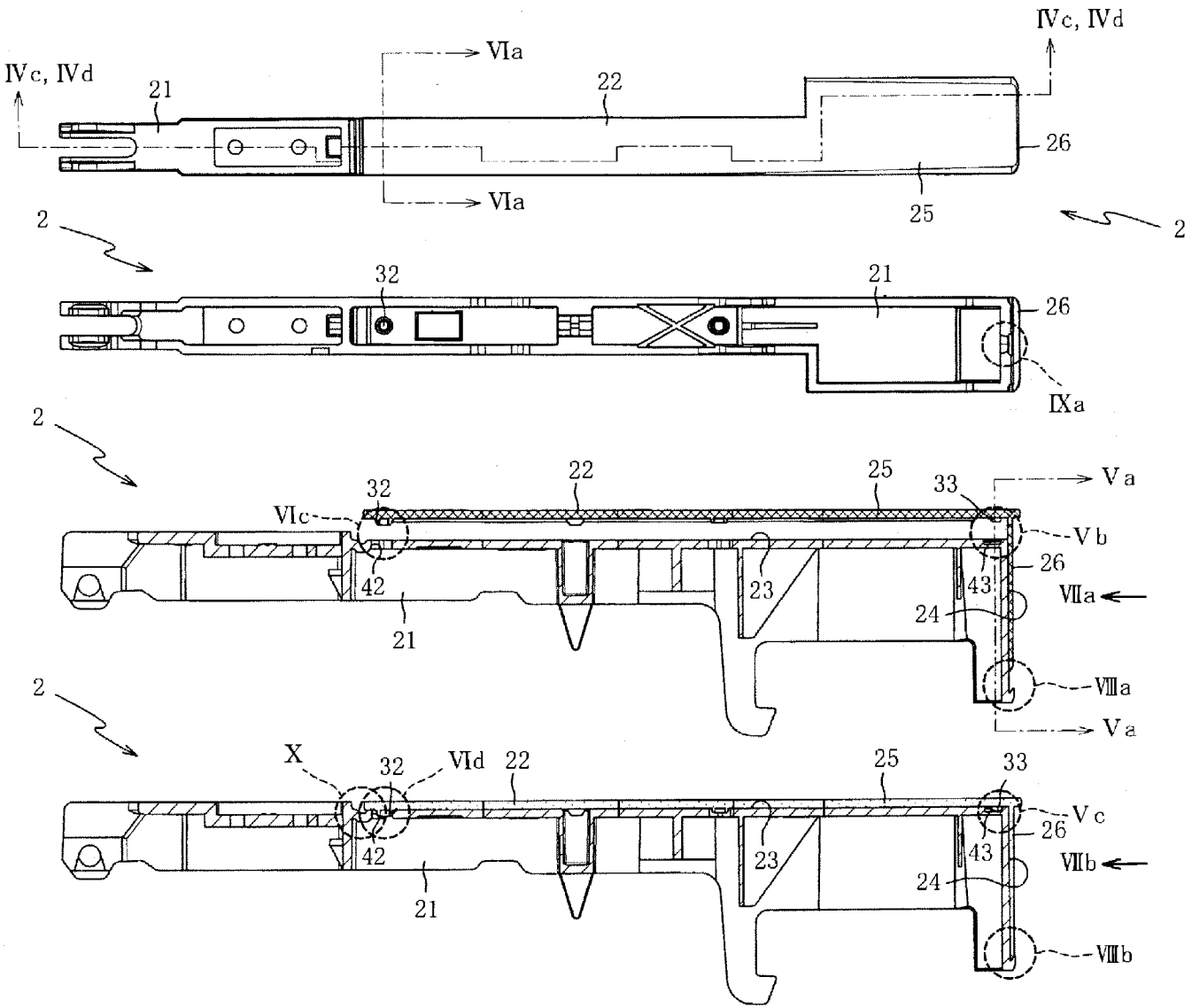
FIGS. 4(*a*)-(*d*) are various views illustrating the exterior and the cross-section of an exemplary white key according to an embodiment of the invention, wherein FIG. 4(*a*) is a top view of the white key, FIG. 4(*b*) is a bottom view of the white key, FIG. 4(*c*) is a cross-sectional view along IVc-IVc of the white key prior to welding, and FIG. 4(*d*) is a cross-sectional view along IVd-IVd of the white key after welding.

FIGS. 4(*a*)-(*d*) illustrate the exterior and cross-sectional views of the exemplary white key 2. FIG. 4(*a*) is a top view of the white key 2, and FIG. 4(*b*) is a bottom view of the white key 2. FIG. 4(*c*) is a cross-sectional view taken along IVc-IVc of FIG. 4(*a*) of the white key 2 prior to welding. FIG. 4(*d*) is a cross-sectional view taken along IVd-IVd in FIG. 4(*a*) of the white key 2 after welding. Further details of the embodiment of FIGS. 4(*a*)-(*d*) are described with reference to FIGS. 5-10.

With reference to FIGS. 5(*a*)-(*c*), a description is provided of a receptacle or housing space 43 on the base 21 and a protuberance area 33 on the plate 22. FIGS. 5(*a*)-(*c*) are cross-sectional views displaying the configuration of the protuberance area 33 and the receptacle 43. FIG. 5(*a*) is a cross-sectional view taken along Va-Va (see FIG. 4(*c*)) of the edge of the white key 2. FIG. 5(*b*) is a detailed cross-sectional view of the area enclosed in the dotted line Vb in FIG. 4(*c*). FIG. 5(*c*) is a more detailed cross-sectional view of the area enclosed by the dotted line Vc in FIG. 4(*d*).

As shown in FIG. 5(*a*), the length of the white key 2 (base 21 and plate 22) in the Y dimension is t1. The distance from the exterior surface 33*a* of the protuberance area 33 to the outer edge of the plate 22 is t2. The distance between the exterior surfaces 33*a* of the two protuberance areas 33 is t3. For the base 21, the distance from the exterior surface 43*a* of the receptacle 43 to the outer edge of the base 21 is also t2, and the distance between the outer edges 43*a* of the two receptacles 43 is also t3.

Therefore, when merging the plate 22 with the base 21, it is possible to properly position the plate 22, because the exterior surfaces 33*a* and the exterior surfaces 43*a* are aligned.

As shown in FIG. 5(*b*), an edge of the protuberance 33 in the X dimension is a side 33*b*. The corresponding edge of the housing space 43 in the X dimension is a side 43*b*. Again, the distance between the side 33*b* and the middle surface of the front surface area 25 and the distance between the outer surface of the front surface 24 and the side 43*b* are both t4.

Therefore, as shown in FIG. 5(*c*), when merging the plate 22 with the base 21, it is possible to select a merge location on the plate 22 along the X dimension, because the side 33*b* and the side 43*b* are aligned.

The sides 33*a*, 33*b*, 43*a* and 43*b* are aligned along the Z dimension on the white key 2. Thus, the sides 33*a*, 33*b* start from the top surface area 25 along an approximately perpendicular path, and the sides 43*a*, 43*b* start from the top surface 23 along an approximately perpendicular path. For example, if the sides 33*a*, 33*b*, 43*a*, and 43*b* have a slant from the edges to the rear end, there will be difficulty in having the protrusion area 33 placed in a location that is easy to disconnect from. If the sides 33*a*, 33*b*, 43*a* and 43*b* have an incline from the rear end to the edge (in the X dimension from the right to the left), the protrusion area 33 becomes a hindrance when the plate 22 is planted on top of the base 21. If using this example, the protrusion area 33 can limit the possibility of being disconnected from the receptacle 43, and it is possible to prevent the protrusion 33 from becoming a strain on the receptacle 43, because the sides 33*a* and 33*b* protrude from the top surface area 25 along an approximately perpendicular path, and the sides 43*a* and 43*b* start from the top surface 23 along an approximately perpendicular path.

In this example, arranging the sides 33*a*, 33*b*, 43*a*, and 43*b* onto a plane makes a semicircle-shaped protuberance on the protuberance area 33, and a housing device may be provided with a corresponding semicircle-shaped crevice. In this case, the protuberance area 33 and the housing space 43 are merged at a location where the edge of the protuberance area 33 and the exterior, curved surface, and the edge of the receptacle 43 and the exterior, curved surface are conjoined. Alternatively, the shape of the edge of the protuberance area 33 and the exterior edge, and the edge of the receptacle 43 and the exterior edge conjoined to the edges of the protuberance area 33 and the receptacle 43, need not be flat but may be curved surfaces, or have pointed shapes, or other suitable shapes.

Furthermore, the protuberance area 33 has the sides 33*a* and 33*b*, while the housing space 43 may have the sides 43*a* and 43*b* that attach with the sides 33*a* and 33*b*. Also, for the protuberance area 33 and the receptacle 43, each pair may include one protuberance area 33 with one housing space 43, or may be two or more protuberance areas 33 for each one housing space 43.

The distance between the surface of an end 33*a* of the projection area 22 to the exterior surface of the plate 22 is the same distance (t2) as the distance between the surface of an end 43*a* of the housing space 43 to the exterior surface of the base 21. In addition, the distance between the surface of an end 33*b* of the projection area 33 to the interior of the front section 26 of the plate 22 is the same distance (t4) as the distance between the surface of an end 43*b* of housing space 43 to the surface of the front 24 of the base 21. However, in other embodiments, the distance between the surface of an end 33*a* of the projection area 22 to the exterior surface of the plate 22 can be made different from the distance between the surface of an end 43*a* of the housing space 43 to the exterior surface of the base 21. Similarly, the distance between the surface of an end 33*b* of the projection area 33 to the interior of the front section 26 of the plate 22 can also be made to be different from the distance between the surface of an end 43*b* of the housing space 43 to the surface of the front 24 of the base 21. In that regard, when putting plate 22 on base 21, the distances t2 and t4 need not be completely in agreement, but should be sufficiently accurate to set an attachment position. For example, the distance between the surface of an end 33*a* of the projection area 33 to the exterior surface of the plate 22 is the distance (t2), which may be slightly longer than the distance between the surface of an end 43*a* of the housing space 43 to the exterior surface of the base 21 (t2'), where:

t2-t2'>0 when t2>t2'. Similarly, the distance between the surface of an end 33*b* of the projection area 33 to the interior of the front section 26 of the plate 22 (t4) is a distance slightly longer than the distance between the surface of an end 43*b* of housing space 43 to the surface of the front 24 of the base 21 (t4'), where t4-t4'=about 0.1 mm.

Next, with reference to FIGS. 6(*a*)-(*d*), a description of the protrusion area 32 on the plate 22 and the hole 42 on the base 21 is provided. FIGS. 6(*a*)-(*d*) are cross-sectional views displaying the structure of the protrusion area 32 and the hole 42. FIG. 6(*a*) is a cross-sectional view taken along the VIa-VIa (FIG. 4(*a*)) of the white key 2. FIG. 6(*b*) is a detailed cross-sectional view of a section surrounded by the dotted line VIb in FIG. 4(*a*). FIG. 6(*c*) is a detailed cross-sectional view of a section surrounded by the dotted line VIc in FIG. 4(*c*). FIG. 6(*d*) is a detailed cross-sectional view of a section surrounded by the dotted line VId in FIG. 4(*d*).

As shown in FIGS. 6(*a*) and (*b*), in one embodiment, the protrusion area 32 is a sloped area made up of a lower tier 32*a* on a circular cone protruding from the middle surface of the top surface area 25 (the side on the base 21), a central tier 32*b* on a cylinder connected to the lower tier 32*a*, and an upper tier 32*c* on the cone connected to the central tier 32*b*. Also, for the opening or hole 42, an opening 42*a* is formed on top of the top surface 23. The length of the opening 42*a* in the Y dimension is the approximately the diameter of the central tier 32*b*. The length of the opening 42*a* in the Y dimension and the diameter of the central tier 32*b* are t5.

Additionally, as shown in FIG. 6(*c*), the location where the plate 22 is placed with the base 21 is the location where the opening 42*a* and the surface of the upper tier 32*c* are aligned. The length of the opening 42 in the X dimension is t6, which should be longer than t5 in the Y dimension. Thus, the opening 42 has a generally elliptical crevice (see FIG. 3(*c*)).

Also, the plate 22 moves from its place in FIG. 6(*c*) to a lower region along an approximately perpendicular direction (Z dimension), and if welded using ultrasonic waves once it merges with the base 21, the incline surface on the upper tier 32*c* is welded while being slid through the opening 42*a* to the rear end (left side in the X dimension), because the plate 22 is pressed down to the base 21. Because the surface of the lower tier 32*a* also has an inclined surface, if welded with ultrasonic waves, the plate 22 is urged to the rear side of opening 42. As a result, it is possible to improve the quality of the exterior because it is possible to prevent cracks or gaps from forming between the front surface 24 on the base 21 and the front surface area 26 on the plate 22.

As shown in FIG. 6(*d*), if the plate 22 is affixed with the base 21, a part of the opening or hole 42 and the protrusion area 32 is melted together, and becomes a melted area 27, which will secure the plate 22 with the base 21. Also seen in FIG. 6(*b*), the plate 22 is welded while being guided to the center point in the Y dimension, because the diameter of the central tier 32 and the length of the opening or hole 42 in the Y dimension are roughly the same lengths (t5). Therefore, not only is the plate 22 extended to the rear end in the X dimension, it is also possible to select a location along the Y dimension simultaneously.

Regarding the protrusion area 32, areas making up the lower tier 32*a*, the central tier 32*b* and the upper tier 32*c* may have a protrusion area on only one cylinder extending out from the middle surface of the upper surface area 25. If the shape contains an incline from one end to the other, the plate 22 would be extended to the end side when welding with ultrasonic waves.

Next, with reference to FIGS. 7 and 8, a description of the composition of a front end of a white key 2 is provided. FIGS. 7(*a*)-(*b*) illustrate the front end of the exemplary white key 2. FIG. 7(*a*) shows the white key 2 on arrow VIa prior to welding. FIG. 7(*b*) shows the white key 2 on arrow VIIIb after welding. FIGS. 8(*a*)-(*b*) are detailed illustrations of a lower section of the front end of the white key 2. FIG. 8(*a*) is a detailed cross-sectional view of a section encompassed by the dotted line VIIIa in FIG. 4(*c*). FIG. 8(*b*) is a detailed cross-sectional view of a section encompassed by the dotted line VIIb in FIG. 4(*d*).

As shown in FIG. 7(*a*), on the lower end of the base 21 (Z dimension), a pair of supporters 44, each protruding from the front surface 24 to the front side, are installed on the left and right sides (in Y dimension). As shown in FIG. 8(*a*), if the supporter 44 is viewed from a transverse direction, it appears in the form of a general shape of an "L." For the lower section of the front surface 26 on the plate 22, an incline 34 is formed at a location targeted by each supporter 44. A section included in the incline 34 becomes a fitting space 35, suited to fit into the space between the supporters 44.

As shown in FIG. 7(*b*), if the plate 22 is affixed to the base 21, the supporters 44 and the inclines 34 are conjoined, with incline 34 being supported by supporters 44. Fitting space 35 is fitted in the space between supporters 44. Therefore, fitting space 35 is able to go into a location along a path (Y arrow) on plate 22, because it fits in the space between supporters 44. Also, as shown in FIG. 8(*b*), after welding the plate 22 with the base 21, when pressing keys, it is possible to stop the front surface area 26 from moving loosely and also reduces the occurrence of undesired noises as the inclines 34 and the supporters 44 are conjoined.

Figure 9A:
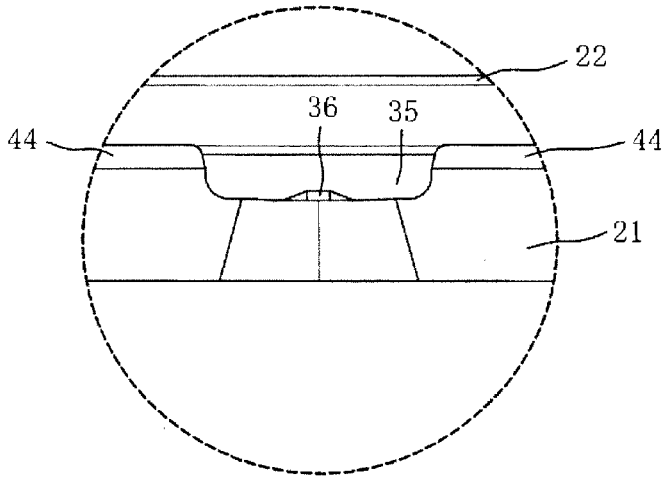
FIGS. 9(*a*)-(*c*) illustrate the composition of the lower front ends of the base and the plate according to an embodiment of the invention, wherein FIG. 9(*a*) is a detailed cross-sectional view of a section encompassed by dotted line IXa (FIG. 4(*b*)), FIG. 9(*b*) is a perspective view of the front end section of the front surface area according to an embodiment of the invention, FIG. 9(*c*) is a perspective view of the lower section of the front surface.
Figure 9B:
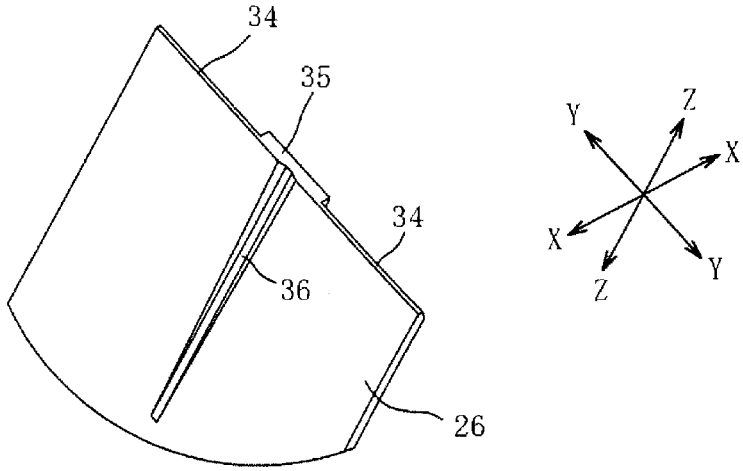
Figure 9C:
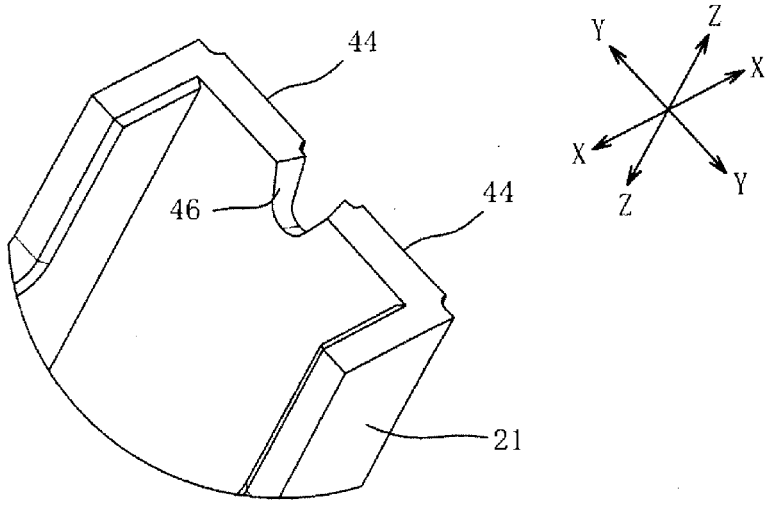

Next, with reference to FIGS. 9(*a*)-(*c*), a description of the lower part of the front end of the plate 22 and the base 21 is provided. FIGS. 9(*a*)-(*c*) feature the composition of the lower front ends of the base 21 and the plate 22. FIG. 9(*a*) is a detailed cross-sectional view of a section encompassed by dotted line IXa on FIG. 4(*b*). FIG. 9(*b*) is a squint view of the front end section of the front surface area 26. FIG. 9(*c*) is a squint view of the lower section of the front surface 23.

As shown in FIG. 9, a groove 36 is formed on the middle surface of a fitting element 35 on the plate 22. A notch area 46 is formed at the location targeted by the groove 36 on the base 21. As shown in FIG. 9(*b*), the groove 36 runs from the lower end of the front surface area 26 (top side, Z dimension), and the depth of the groove reduces while the width of the groove shortens along its length. As illustrated in FIG. 9(*c*), the notch area 46 runs from the lower end of the front surface 24 (top view, Z dimension) to the top surface 23 (bottom view, Z dimension), and forms a "U" shaped notch.

The groove 36 and the notch 46 allow for applying an adhesive with ease from the groove 36 to the notch 46 once the base 21 and the plate 22 have been welded together. If the plate 22 and the base 21 are welded together and a new gap or crack forms between the front surface 24 and the front surface area 26, the product can be defective. However, the product can be improved or made operable by applying an adhesive from the notch 46 to the groove 36 to affix the front surface 24 and the front surface area 26.

Figure 10:
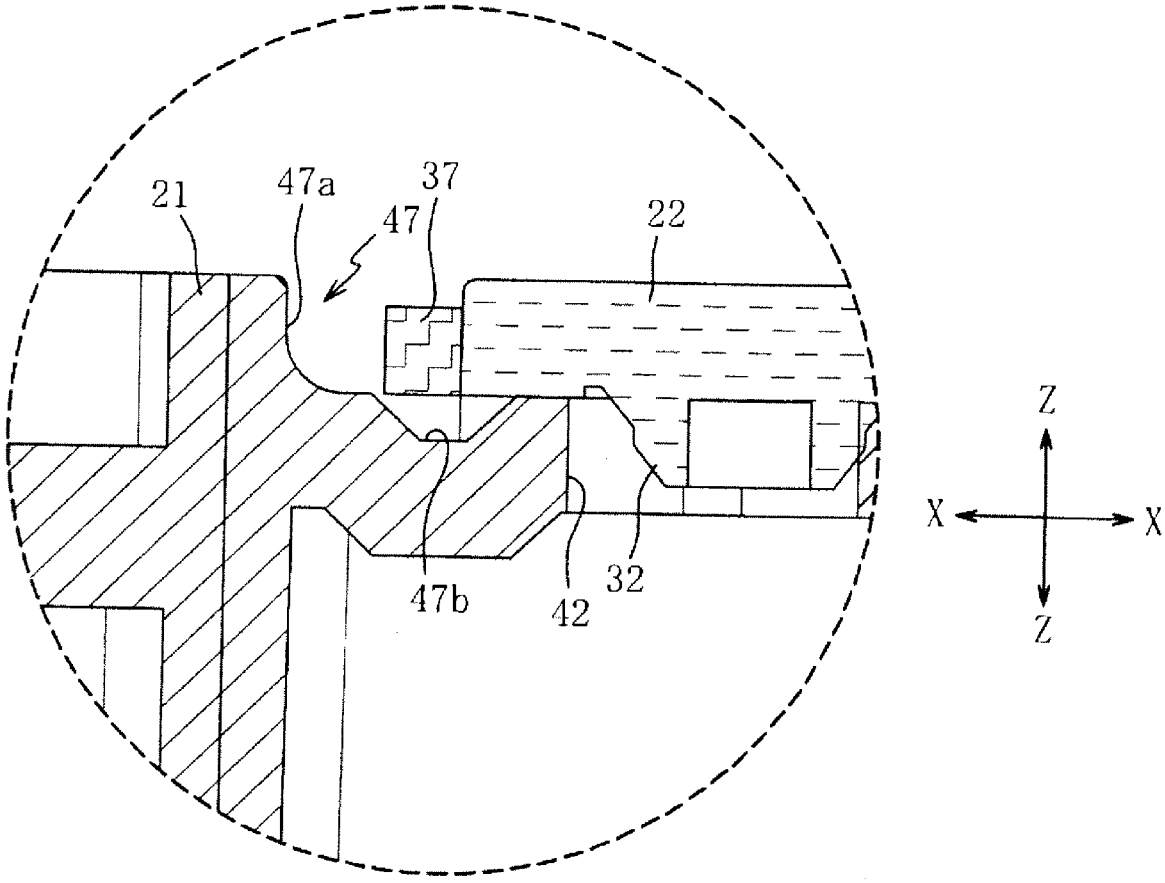
FIG. 10 is a cross-sectional view illustrating a section encompassed by dotted line X in FIG. 4(*d*).

Next, with reference to FIG. 10, a description of the structure of the rear end of the plate 22 is provided. FIG. 10 is a cross-sectional view showing the rear area of the plate 22 and a detailed cross-sectional view of a section encompassed by the dotted line X in FIG. 4(*d*).

Here, an explanation of the plate 22 as a moulded element is provided. In one embodiment, the plate 22 has a gate on the exterior surface, because it has been moulded. In this situation, however, if the gate is not removed, this will make the white key 2 less aesthetically pleasing, and because there is a possibility that it may get damaged during welding, the gate may be removed before placing the plate 22 on top of the base 21. FIG. 10 illustrates such a case where there is a gate 37 on the rear end (left side, X dimension) of the plate 22.

On the embodiment of the plate 22 shown in FIG. 10, the remaining gate (gate 37) on the rear end is insufficient for processing. On the base 21, a free space 47 exists in a location targeted for the rear end of the plate 22. The free space 47 is composed of a first free space 47*a* located on the rear end (X dimension) and a second free space 47*b* located on the bottom of the long path of the white key 2 (Z dimension).

The first free space 47*a* is an empty space for housing the gate remainder 37 on the plate 22 and is formed at a large empty space able to house the shape of the gate remainder 37 in a non-fixed, moveable state.

The size of the gate remainder 37 unsuitable for operator processing may vary in such cases during normal processing. Without this empty space, in order to avoid damage during welding, it may be necessary to carefully process the gate. In order to avoid this problem, the first free space 47*a* can be generally a sufficiently large space to accommodate various sizes of gate remainder 37.

The second free space 47*b* is also an empty space for housing a gate remainder 37, but the first free space 47*a* is formed to take in the side of the left side in the X dimension while the goal of the second free space 47*b* is to be able to house the lower section in the Z dimension while in a moveable, non-fixed state.

During normal processing, a divided protuberance is easily formed as seen in the Z dimension of the gate remainder 37. If there is no second free space 47*b*, these protuberances will be damaged during welding.

In this situation, by setting up the first free space 47*a* and the second free space 47*b*, it is possible to plan an increase in the operating efficiency because of the possibility of removing the irrelevant gate procession operation once the gate has been formed on this part of the plate 22.

Thus, as explained above, the keyboard device 1, traditionally using an adhesive, is capable of being securely fastened if the base 21 and the plate 22 are conjoined, because the base 21 and the plate 22 are welded together using ultrasonic waves. Therefore, it is possible to prevent the base 21 and the plate 22 from loosening after long term use even if, for example, operators firmly depress the keys.

Also, the plate 22 has the protrusion area 32, the protuberance 33, and the fitting space 35, while the base 21 has the hole 42, the housing space 43, and a pair of supporters 44. Each of these is capable of preventing the base 21 and the plate 22 from being welded at a position other than their proper position because they set the location for the plate 22. Therefore, it is possible to increase production efficiency.

The present invention is not limited to the above examples, and it is possible to easily surmise possible alteration without departing from the aim of this invention.

For example, in the above example, the protuberances 31*a*-31*f* being made up of a convex shape on a straight line, the convex shape could have curved lines, several convex shapes could be made, and straight lines, curved lines, and the scattered shapes could be combined. Also, protuberances 31*a*-31*f* may be formed on the base 21 (instead of the plate 22), while corresponding grooves and indentations may be provided on the plate 22 (instead of the base 21). Alternatively, each of the base 21 and plate 22 may include both protuberances and grooves or indentations that mate with corresponding indentations and grooves on the other of the base 21 and plate 22.

Also, the above examples explain the special characteristics of an exemplary white key 2, but these are also applicable to a black key 3.

While particular embodiments of the present invention have been disclosed, it is to be understood that various different modifications and combinations are possible and are contemplated within the true spirit and scope of the appended claims. There is no intention, therefore, of limitations to the specific disclosure herein presented.

What is claimed is:

1. A keyboard device having a plurality of keys, each key comprising:

a base; and a plate adapted to hide at least one surface of the base;

wherein the base and the plate are merged via ultrasonic welding;

wherein a set of empty spaces is formed between a rear end of the plate and the base, once the plate and the base have merged.

2. The keyboard device of claim 1, wherein the base is formed of a wood-colored resin and the plate is foamed of a white-colored resin.

3. The keyboard device of claim 1, wherein a primary substance of each of the base and the plate is a substantially identical resin.

4. The keyboard device of claim 1, wherein the at least one surface of the base hidden by the plate includes a front side of the base connected to a portion of a top surface of the base.

5. The keyboard device of claim 4, wherein the plate has at least one protrusion area that is melted by ultrasonic welding and protrudes from the top portion of the plate toward the base, and wherein the plate has a surface facing the base and the surface has a first area from the front surface of the base to a predefined distance from the front surface and wherein the ratio of the at least one protrusion area in the first area to the overall first area is greater than the ratio of the at least one protrusion area located outside of the first area to the overall area located outside of the first area.

6. The keyboard device of claim 5, wherein the base includes a hollow shape formed at a location corresponding to a welded portion once the base has merged with the plate.

7. The keyboard device of claim 4, wherein at least one welded portion of the plate has an inclined surface with a slope, and wherein the base includes an opening space conjoined with the inclined area on the plate once the plate has merged with the base.

8. The keyboard device of claim 4, wherein:

the plate includes at least one protrusion area protruding from a top portion of the plate to the base and having a tip to contact a contact area of the base, the base includes at least one space to accommodate the tip of the at least one protrusion area, the distance between the end of the tip of the at least one protrusion area and a front portion of the plate is about the same distance as the distance between the contact area and the front surface of the base.

9. The keyboard device of claim 4, wherein:

the plate includes at least one protrusion area protruding from the top portion of the plate to the base, the base includes a housing gap to accommodate the at least one protrusion area, and wherein the protrusion area is set up in a second path orthogonal to a first path conjoined from end to end;

the projection area intersects a first direction and a right angle that are a pair of projection areas and connects the tip and back end side in a second direction, the base has a contact section which contacts an end of an outside of a pair of the projection areas in the second direction, respectively, the base also has an accommodation section with a space for accommodating at least an end of the pair of projection areas, and the distance between an end of the outside of the pair of projection areas and the edge of the outside surface of the base, in the second direction, is about equal to the distance between the contact section and the edge of the outside surface of the base.

10. The keyboard device of claim 4, wherein the base includes multiple support areas that support a lower surface of the plate once the plate and base have merged, and wherein the plate includes an area that can be inserted into the support areas.

11. The keyboard device of claim 4, wherein a back surface of the plate includes at least one groove, and wherein the base includes at least one notch area corresponding to the grooved area of the plate.

12. A method of forming a key for a keyboard device, comprising:

providing a base having at least a top surface and a front surface;

positioning a plate to hide at least one surface of the base; and applying ultrasonic welding to join the plate to the base;

wherein the plate includes at least one protuberance adapted to engage a corresponding housing space on the base during the positioning step.

13. The method of claim 12, wherein the base is formed of a wood-colored resin and the plate is formed of a white-colored resin.

14. The method of claim 12, wherein the base and the plate have a common primary resin.

15. The method of claim 12, wherein the plate includes at least one protrusion adapted to engage a corresponding groove on the base during the positioning step.

16. The method of claim 12, wherein the plate includes at least one protrusion adapted to engage a corresponding opening on the base during the positioning step.

17. The method for claim 16, wherein the protrusion has an inclined surface.

18. The method for claim 1, wherein at least one side surface of the protuberance aligns with at least one side surface of the housing space to facilitate the positioning of the plate.

* * * * *